US005653369A

United States Patent [19]

White

[11] Patent Number: 5,653,369

[45] Date of Patent: Aug. 5, 1997

[54] FASTENER DRIVING DEVICE WITH IMPROVED CONTROL VALVE ASSEMBLY AND TRIGGER SENSITIVITY ADJUSTMENT

[75] Inventor: Brian M. White, Riverside, R.I.

[73] Assignee: Stanley-Bostitch, Inc., East Greenwich, R.I.

[21] Appl. No.: 559,377

[22] Filed: Nov. 16, 1995

[51] Int. Cl.[6] ..... B25C 1/04

[52] U.S. Cl. ..... 227/8; 227/130; 91/308; 91/309; 91/321; 91/356

[58] Field of Search ..... 227/8, 130; 91/236, 91/307, 308, 309, 321, 356

[56] References Cited

U.S. PATENT DOCUMENTS

| | | | |
|---|---|---|---|
| 3,278,103 | 10/1966 | Juilfs et al. . | |
| 3,278,105 | 10/1966 | Juilfs et al. . | |
| 3,427,928 | 2/1969 | Bade . | |
| 3,547,003 | 12/1970 | Ramspeck . | |
| 3,583,496 | 6/1971 | Fehrs . | |
| 3,895,562 | 7/1975 | El Guindy . | |
| 4,509,668 | 4/1985 | Klaus et al. | 227/130 |
| 4,915,013 | 4/1990 | Moraht et al. . | |
| 5,174,485 | 12/1992 | Meyer | 227/8 |
| 5,370,037 | 12/1994 | Bauer et al. . | |
| 5,522,532 | 6/1996 | Chen | 227/8 |

*Primary Examiner*—Scott A. Smith
*Attorney, Agent, or Firm*—Cushman, Darby & Cushman IP Group of Pillsbury Madison & Sutro LLP

[57] ABSTRACT

A pneumatically operated driving device is constructed and arranged to operate in a single actuation sequence and an automatic actuation sequence. The device includes an improved control valve assembly for communicating reservoir pressure to move a piston in a direction to effect a drive stroke of a fastener driving element and for permitting the piston to move in a direction to effect the return stroke of the fastener driving element. The control valve assembly includes a main valve, a secondary valve, and first and second actuating members for controlling movement of the main and secondary valves, a trigger member for moving the actuating members, and trigger member adjustment structure constructed and arranged to adjust pivotal movement of the trigger member thereby providing operator selection of single actuation followed by automatic actuation of the device, or automatic actuation thereof only. The control valve assembly may be removed from the device as a unit.

11 Claims, 8 Drawing Sheets

FASTENER DRIVING DEVICE WITH IMPROVED CONTROL VALVE ASSEMBLY AND TRIGGER SENSITIVITY ADJUSTMENT

This invention relates to a fastener driving device and, more particularly, to a control valve assembly for an air operated fastener driving device including structure for adjusting the trigger sensitivity.

Conventional control valves for use in a fastener driving device typically include a portable housing defining a guide track, a magazine assembly for feeding successive fasteners laterally into the guide track, a fastener driving element slidable in the drive track, a piston and cylinder unit for moving the fastener driving element through a cycle which includes a drive stroke and a return stroke, and pressure operated structure for controlling communication of the cylinder with air under pressure communicated with the device and with the atmosphere to effect the cycling. In such devices, a single driving stroke occurs upon movement of a trigger stem which actuates a trigger valve. The trigger valve in turn controls a main control valve which is opened to initiate the drive stroke. The return stroke of the fastener driving element is initiated upon release of the trigger stem. When the trigger stem is moved a second length of travel, a second trigger stem is moved into a sealing position which causes the device to work in an automatic mode of operation. The trigger stem must be held in position to maintain the automatic operation.

An object of the present invention is the provision of a fastener driving device of the type described having an improved control valve assembly together with trigger sensitivity adjustment structure permitting the operator to select single actuation followed by automatic actuation of the device, or automatic actuation thereof only. The device is constructed and arranged to be easy to assemble and service.

This objective is obtained by providing a pneumatically operated fastener driving device including a housing defining a fastener drive track, a fastener magazine for feeding successive fasteners laterally into the drive track, a fastener driving element slidably mounted in the drive track for movement through an operative cycle including a drive stroke during which a fastener within the drive track is engaged and moved longitudinally outwardly of the drive track into a workpiece, and a return stroke. A drive piston is connected with the fastener driving element. A cylinder is provided within which the piston is reciprocally mounted. An air pressure reservoir communicates exteriorly with one end of the cylinder via a passageway.

A control valve assembly is provided for opening the passageway and communicating the reservoir pressure within the interior of the one end of the cylinder to move the piston in a direction to effect the drive stroke of the fastener driving element and for closing the passageway and communicating the one end of the cylinder with atmosphere for permitting the piston to move in a direction to effect the return stroke of the fastener driving element. The control valve assembly includes a main valve disposed within a housing assembly between the one end of the cylinder and the pressure reservoir and moveable between open and closed positions to open and close the passageway. Secondary valve structure is constructed and arranged with the housing assembly to permit the device to operate in an automatic sequence of operation.

The control valve assembly includes a first actuating member, for initiating a single actuation sequence of operation, which is constructed and arranged for movement from a sealed position into an unsealed position for initiating movement of the main valve to its open position, thereby initiating movement of the fastener driving element through a fastener drive stroke. A second actuating member is mounted for movement from a normal, unsealed position into an operative, sealed position for initiating movement of the secondary valve structure, permitting the device to operate in the automatic sequence of operation.

A trigger assembly is mounted for manual movement from a normal, inoperative position into an operative position. The first and second actuating members are constructed and arranged such that (1) pivotal movement of the trigger assembly a first distance of travel moves the first actuating member from its normal, sealed position to its operative, unsealed position causing the device to single actuate and (2) pivotal movement of the trigger assembly further to a second distance of travel moves the second actuating member from its normal, unsealed position to its operative, sealed position causing automatic actuation of the device.

Trigger assembly adjustment structure is provided and is constructed and arranged to engage a portion of the trigger assembly in its inoperative position so as to control pivotal movement of the trigger assembly portion, thereby providing operator selection of single actuation followed by automatic actuation of the device, or automatic actuation thereof only.

The trigger assembly includes a trigger member pivoted to said housing assembly and a rocker arm pivoted to said trigger member in such a manner so as to engage the first actuating member when the trigger assembly is moved the first distance of travel. The trigger assembly adjustment structure includes a trigger stop constructed and arranged to engage and limit movement of the rocker arm when the trigger assembly is in its inoperative position, and an adjustment member cooperable with the trigger stop so as to manually adjust a position of the trigger stop. When the trigger stop is adjusted towards the trigger assembly to a first position of operation, movement of the trigger assembly to the first distance of travel causes the rocker arm to engage the first actuating member resulting in a single actuation of the device and further movement of the trigger assembly to the second distance of travel causes the trigger member to engage the second actuating member resulting in automatic actuation of the device.

When the trigger stop is adjusted away from the trigger assembly to a second position of operation, movement of the trigger assembly will actuate only the second actuating member so that the device will operate only in the automatic mode of operation.

These and other objects of the present invention will become more apparent during the course of the following detailed description and appended claims.

The invention may be best understood with reference to the accompanying drawings wherein an illustrative embodiment is shown.

DESCRIPTION OF THE PREFERRED EMBODIMENTS

Figure 1:
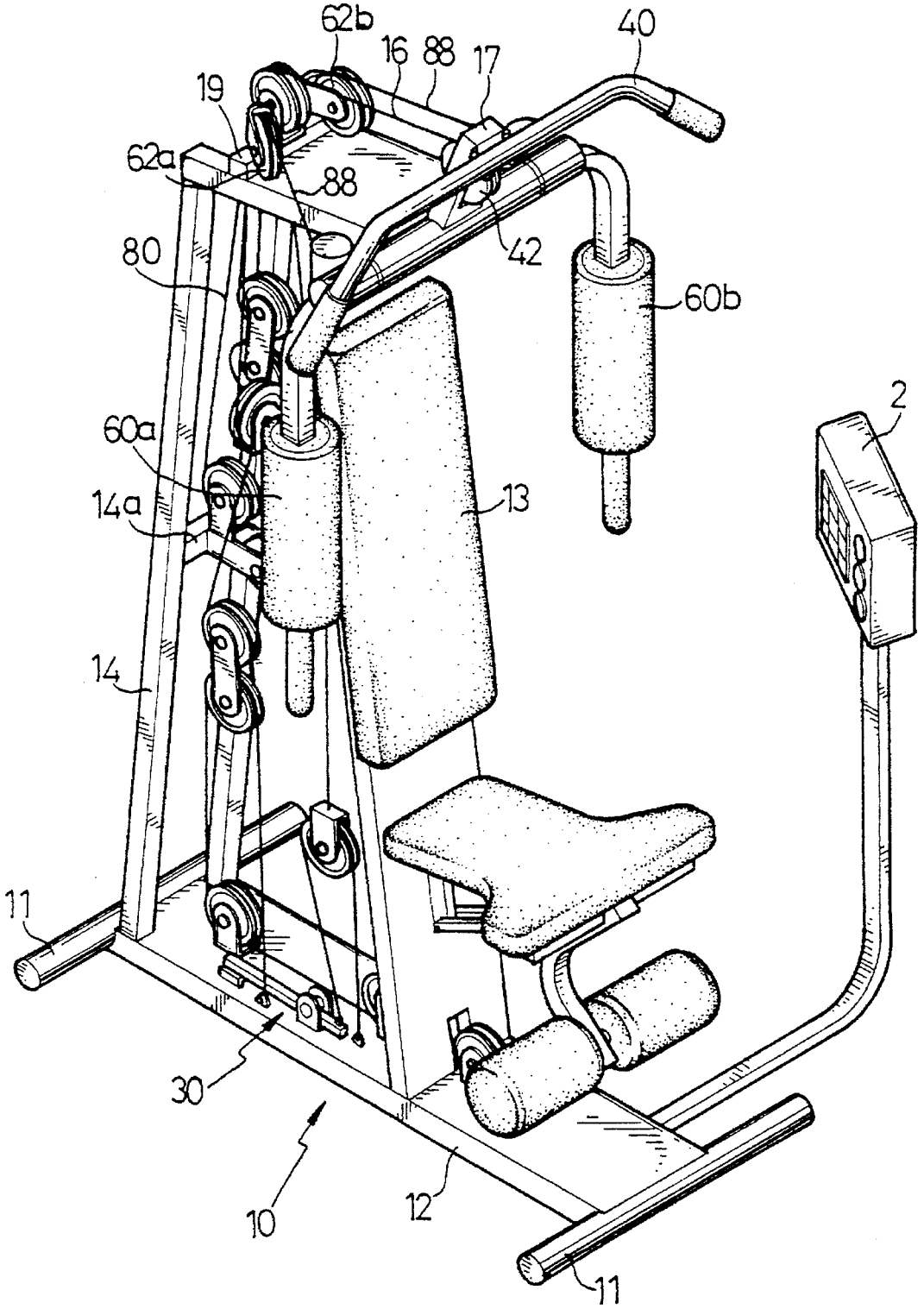
FIG. 1 is a sectional view of a control valve assembly of a fastener driving device, provided in accordance with the principles of the present invention, shown in a rest position.
Figure 2:
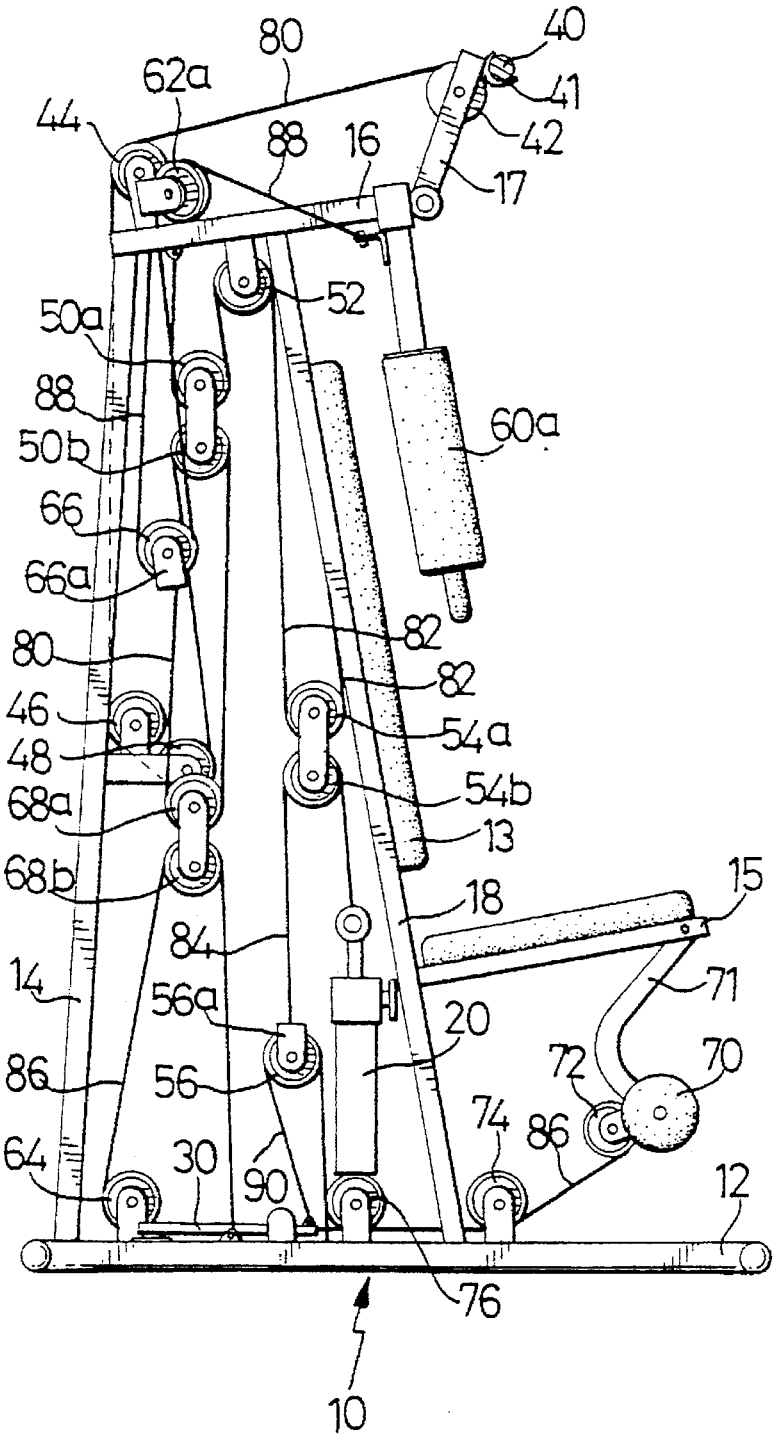
FIG. 2 is a view similar to FIG. 1, with the control valve assembly shown in a single actuation mode of operation, in position to drive a piston.
Figure 3:
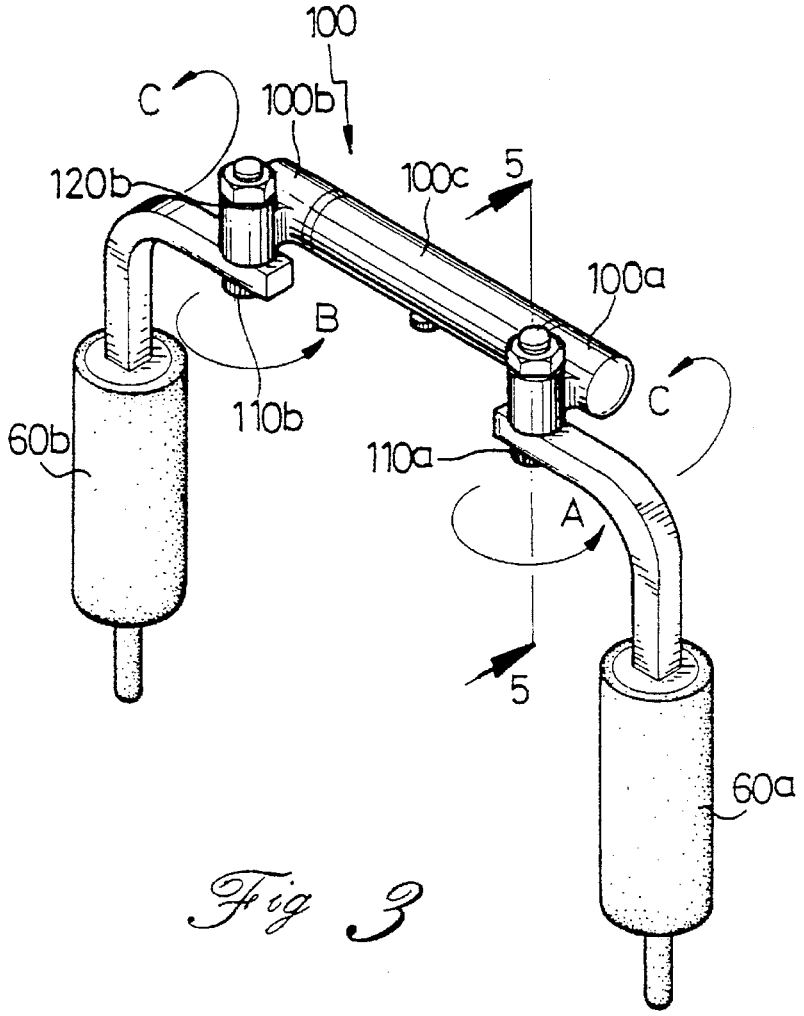
FIG. 3 is a sectional view similar to FIG. 1, showing the control valve assembly in an automatic actuation mode of operation in position to drive the piston.

Referring now more particularly to the drawings, a pneumatically operated fastener driving device, generally indicated at 10 is shown in FIG. 1, which embodies the principles of the present invention. The device 10 includes a housing, generally indicated at 12, having a cylindrical housing portion 13 and a frame housing portion 15, extending laterally from the cylindrical housing portion 13. A hand grip portion 14 of hollow configuration is defined in the frame housing portion 15, which constitutes a reservoir chamber 22 for air under pressure coming from a source which is communicated therewith. The housing 12 further includes the usual nose piece defining a fastener drive track 16 which is adapted to receive laterally therein the leading fastener 17 from a package of fasteners mounted within a magazine assembly, generally indicated at 18, of conventional construction and operation. Mounted within the cylindrical housing portion 13 is a cylinder 20 which has its upper end disposed in communicating relation exteriorly with the reservoir chamber 22. Mounted within the cylinder 20 is a piston 24. Carried by the piston 24 is a fastener driving element 26 which is slidably mounted within the drive track 16 and movable by the piston and cylinder unit through a cycle of operation which includes a drive stroke during which the fastener driving element 26 engages a fastener within the drive track 16 and moves the same longitudinally outwardly into a workpiece, and a return stroke.

In order to effect the aforesaid cycle of operation, there is provided a control valve assembly, generally indicated at 28, constructed in accordance with the present invention. The control valve assembly 28 includes a housing assembly, which, in the illustrated embodiment includes a trigger housing 64 coupled to the frame portion 15 by pin connections at 31, and a valve housing 35 secured to the trigger housing 64 by fasteners, preferably in the form of screws 33. Housings 64 and 35 are preferably molded from plastic material. O-rings 47 and 49 seal the valve housing 35 within the frame portion of the housing 12.

Referring now more particularly to FIGS. 1–4, 8 and 9, the control valve assembly 28 includes a main control valve structure, generally indicated at 32, including a main valve 34 mounted with respect to the valve housing 35. The main control valve structure 32 is mounted with respect to a passageway 36 between one end 37 of the cylinder 20 and the reservoir chamber 22. The valve 34 is moveable between opened and closed positions to open and close the passageway 36 and has a first annular pressure responsive surface 38 and a second, opposing annular pressure responsive surface 40. When the main valve is closed, the surface 40 extends beyond annular housing seat 44, as shown in FIG. 1. Spring structure, in the form of a coil spring 52 biases the main valve 34 to its closed position, together with reservoir pressure acting on surface 38. Thus, the force of the spring 52 plus the force acting on surface 38 is greater than the force due to pressure acting on the opposing surface 40, which results in the keeping the main valve 34 in its closed position. The spring 52 is disposed between a surface of an exhaust seal 53 and a surface of the main valve 34. The exhaust seal 53 is fixed to the valve housing 35 and an upper annular surface thereof contacts an inner surface of the main valve 34 when the main valve 34 is in its fully opened position (FIG. 2) thereby closing exhaust path 106.

A urethane seal member 43 is attached to the main valve 34 defining surface 40 and ensures sealing when the main valve 34 is closed. As shown in FIG. 1, when the main valve 34 is in its closed position, an upper surface of the main valve 34 is in sealing engagement with seat 44 of the housing 12. O-ring seals 50 are provided for sealing the main valve 34 within its housing 35.

An axial passage structure, generally indicated at 42, is defined through the main control valve structure 32 through the main valve 34 and exhaust seal 53. The passage structure 42 includes passage 67 of the valve housing 35 and passage 69 of the trigger housing 64. The passage structure 42 provides a pressure signal to secondary valve structure, as will become apparent below. Further, an air filter 45 is disposed in the main valve 34.

A pressure chamber 46 is defined between the first pressure responsive surface 38 of the main valve 34, and a portion of the housing 35. The pressure chamber 46 is in communication with the reservoir or high pressure in chamber 22 via feed orifice 48. This high pressure is dumped to atmosphere to open the main valve 34, as will be explained below.

Figure 7:
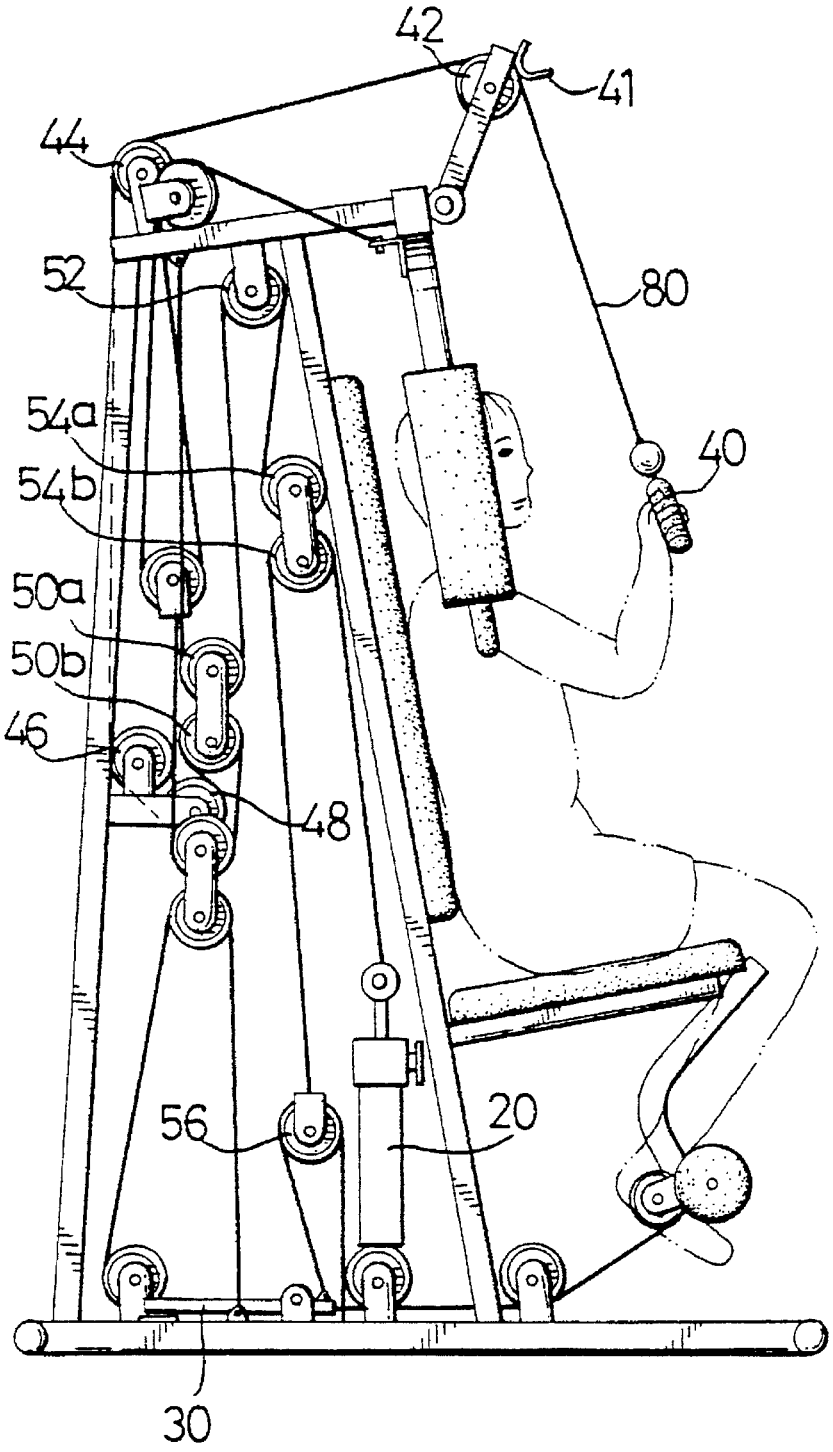
FIG. 7 is a view of the control valve assembly as seen in the direction of arrow A in FIG. 1.
Figure 8:
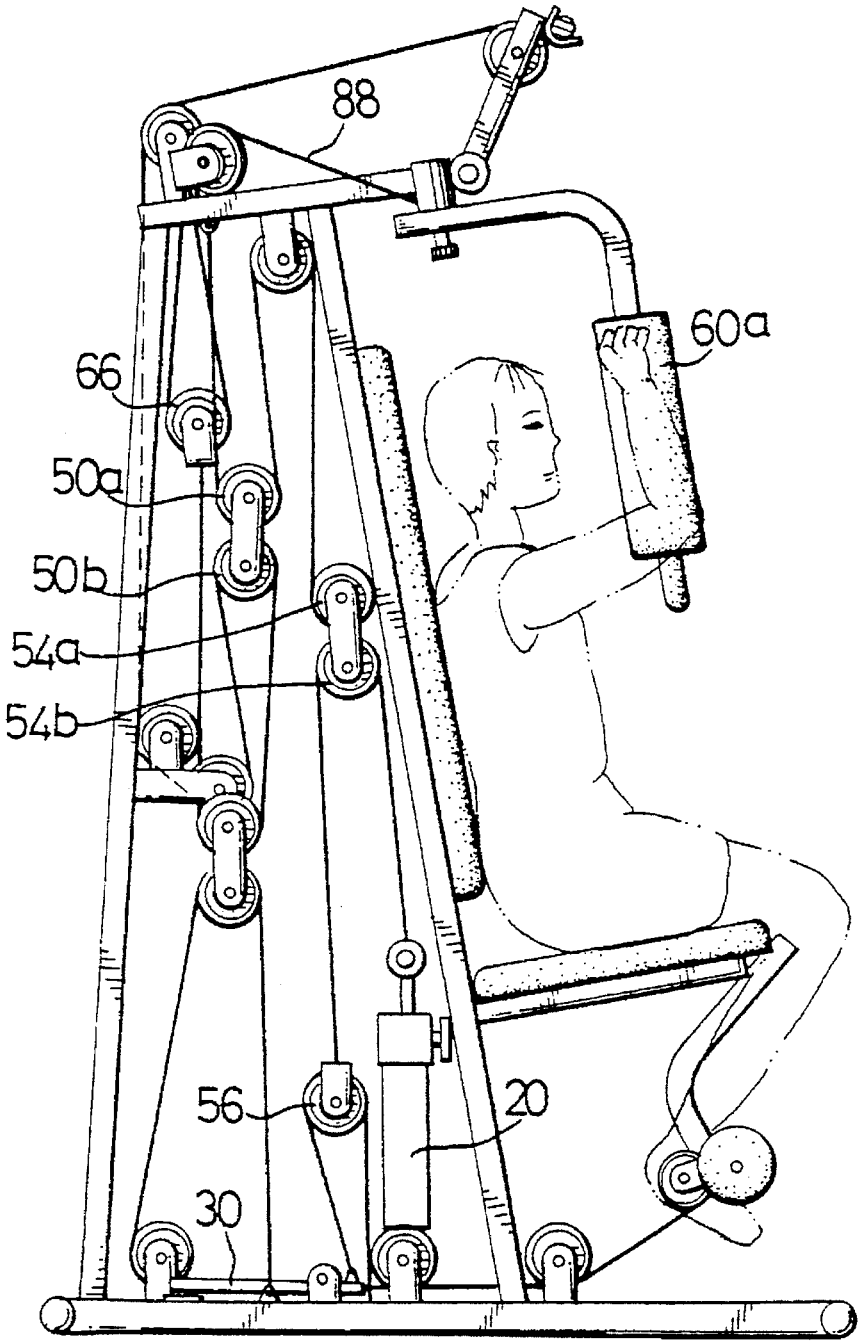
FIG. 8 is a view taken along the line 8–8 of FIG. 7 showing a shuttle valve of the invention in an open position.
Figure 9:
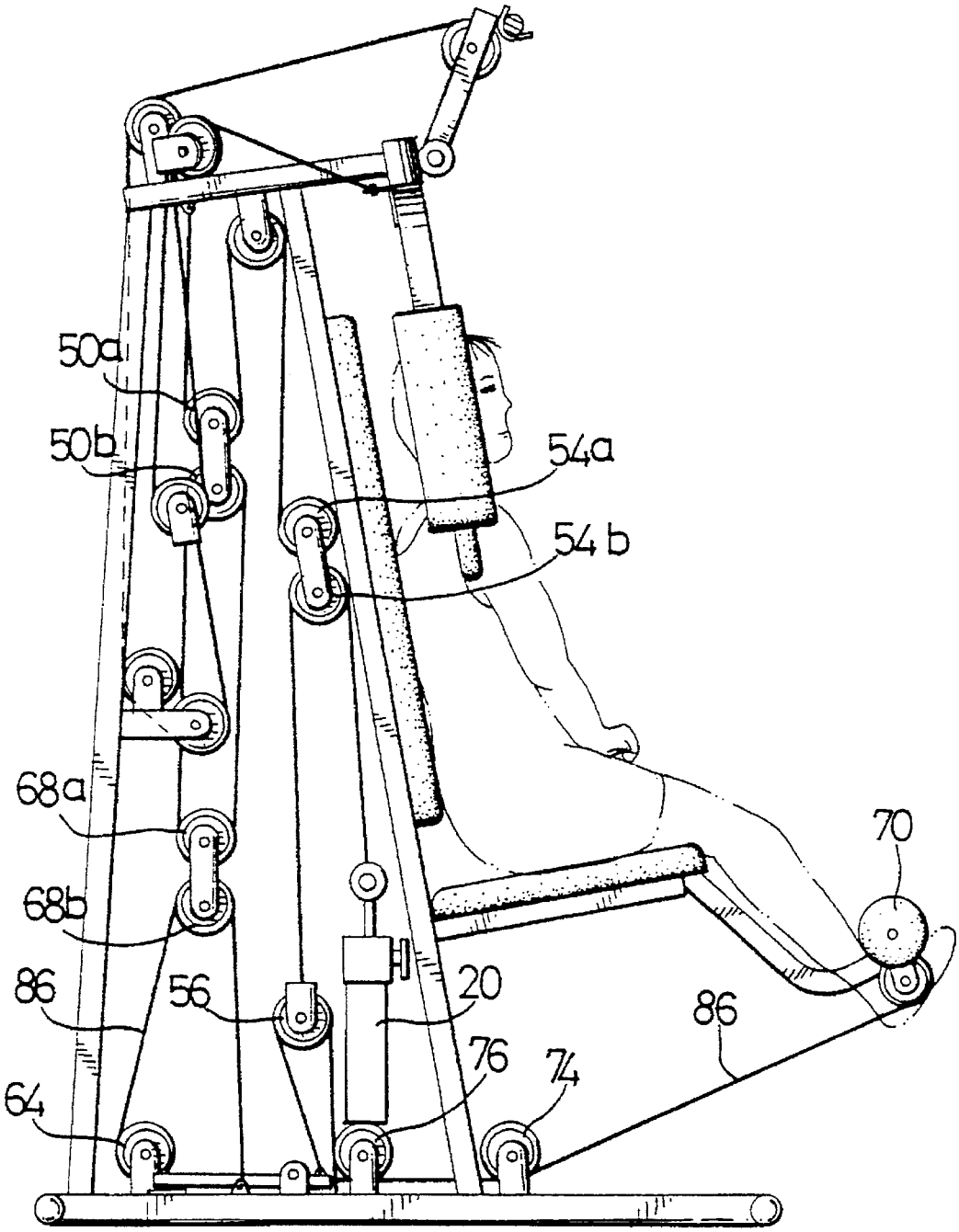
FIG. 9 is a view taken along line 8–8 of FIG. 7 showing the shuttle valve in a closed position.
Figure 10:
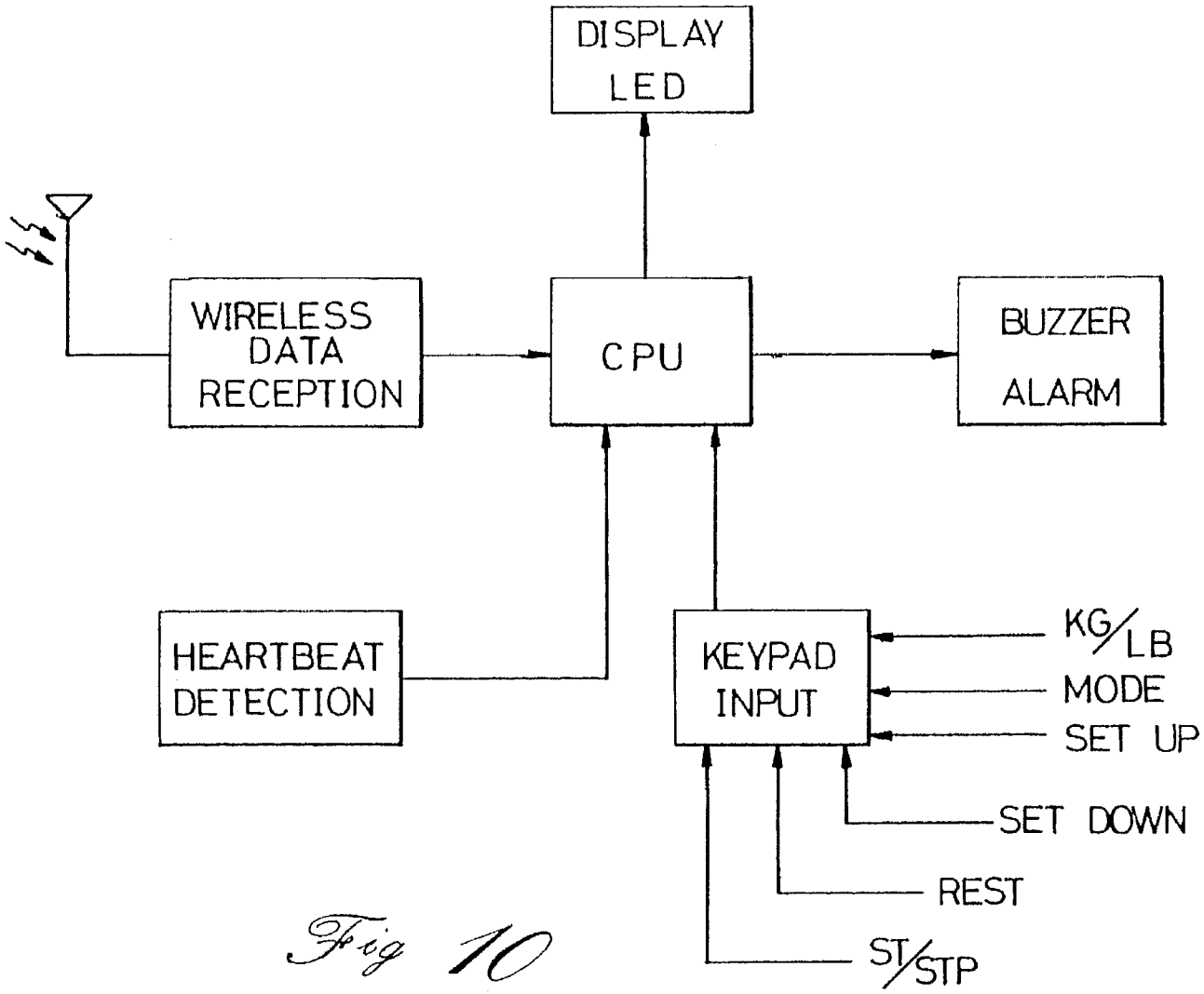
Figure 1:
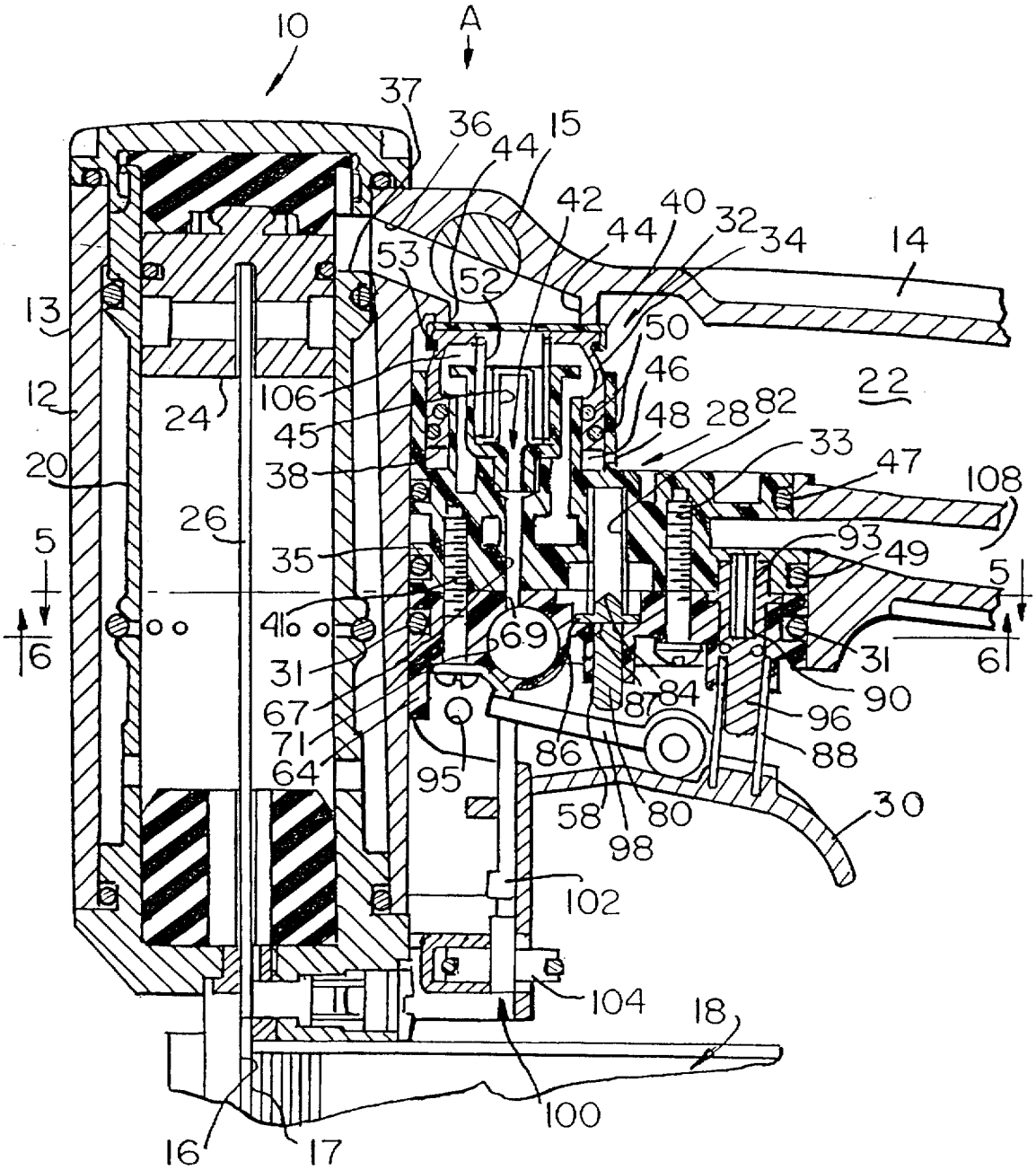
Figure 2:
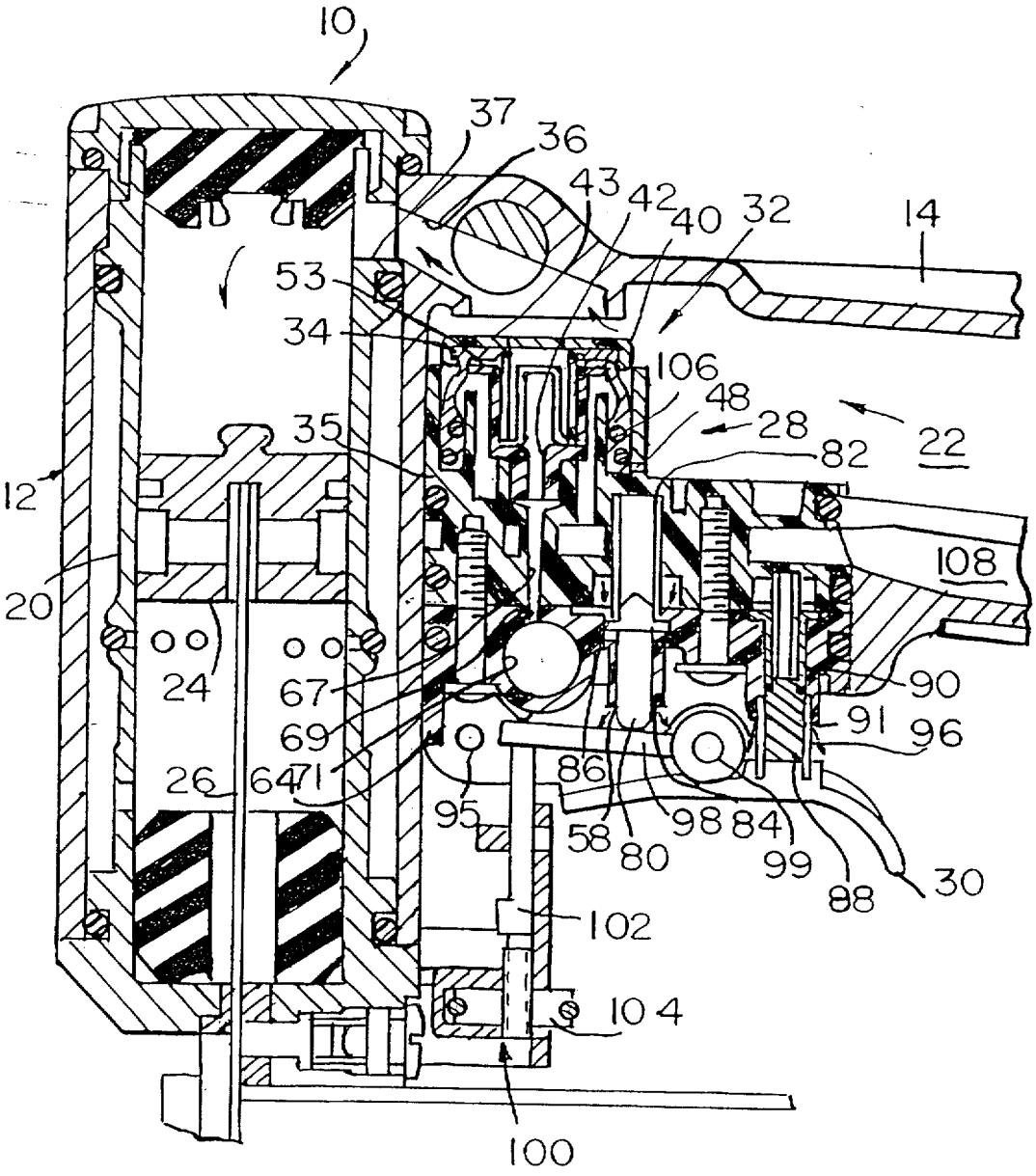
Figure 3:
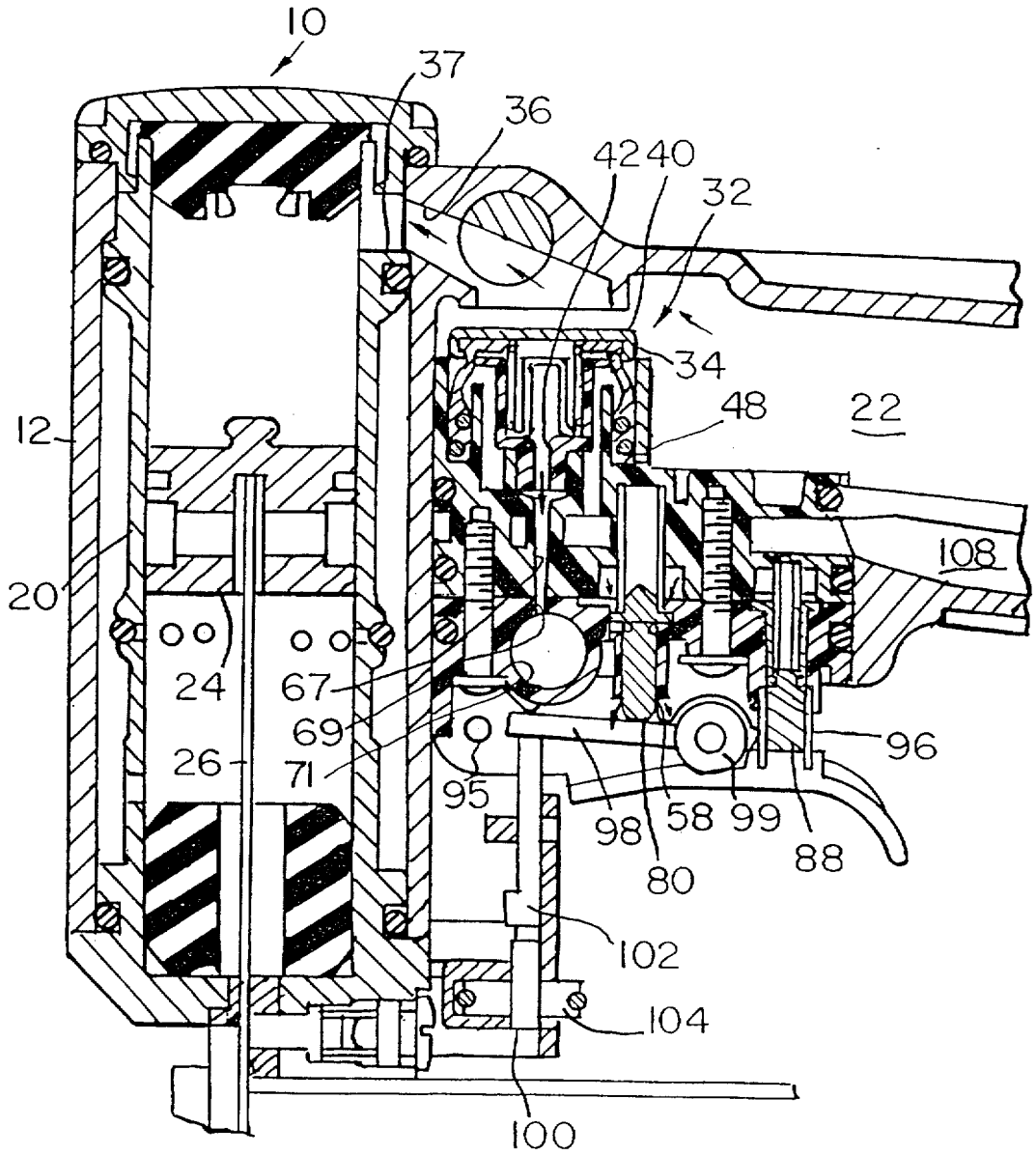
Figure 4:
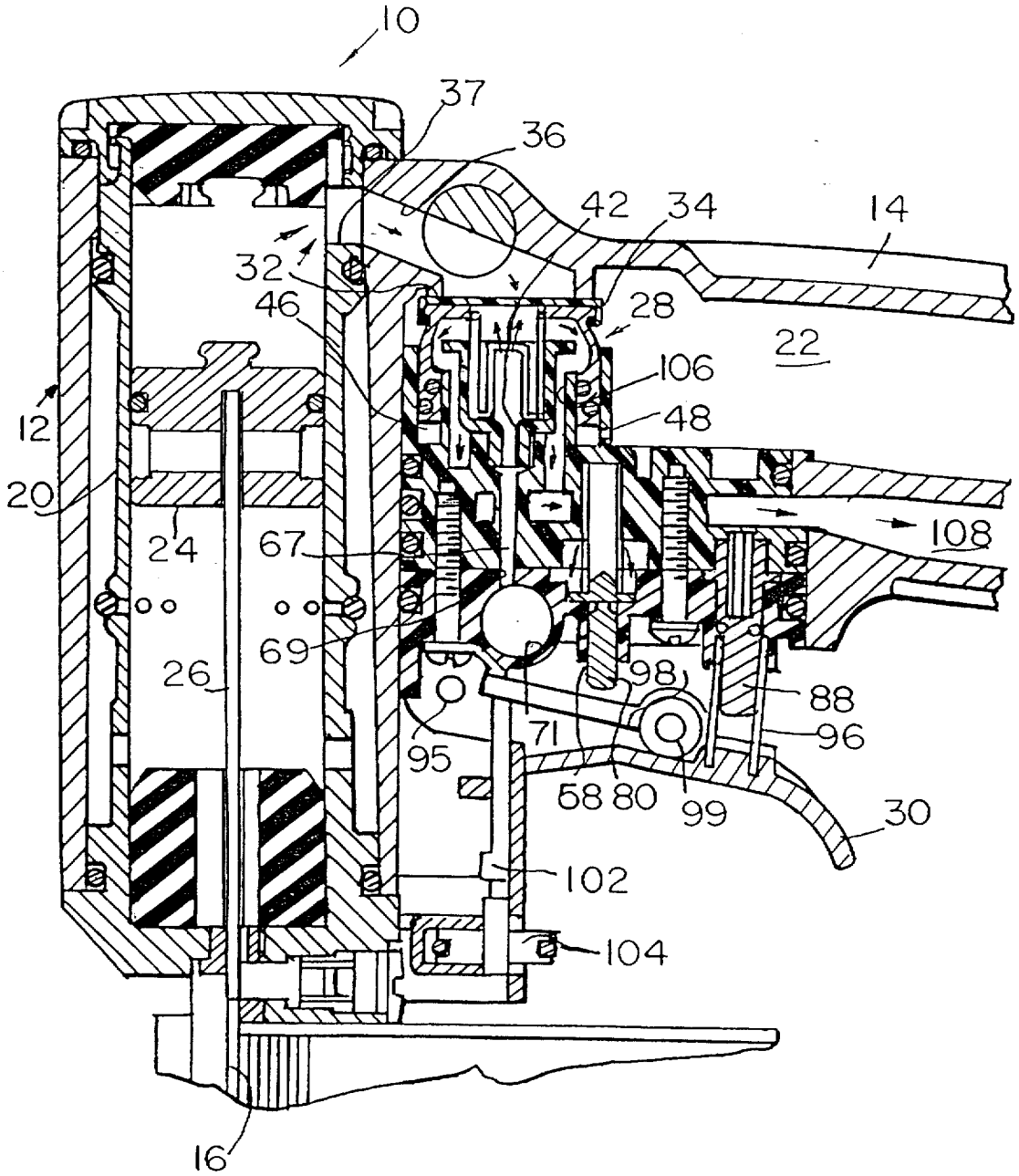
Figure 5:
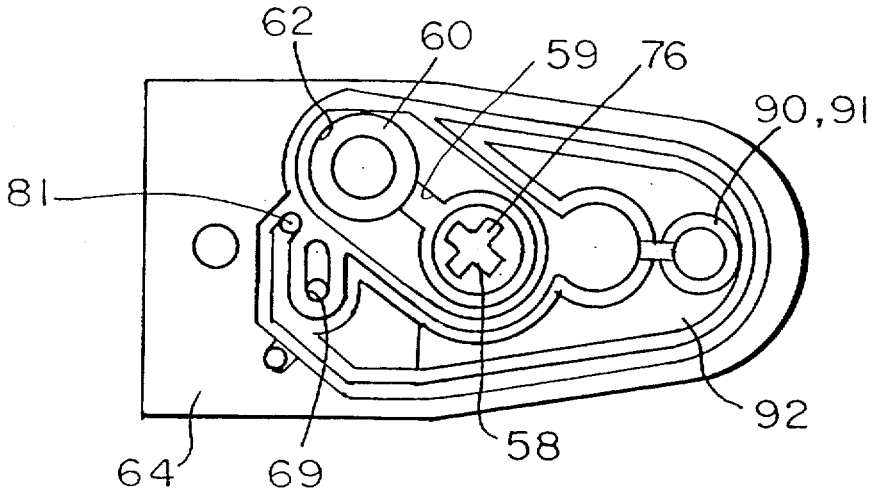
Figure 6:
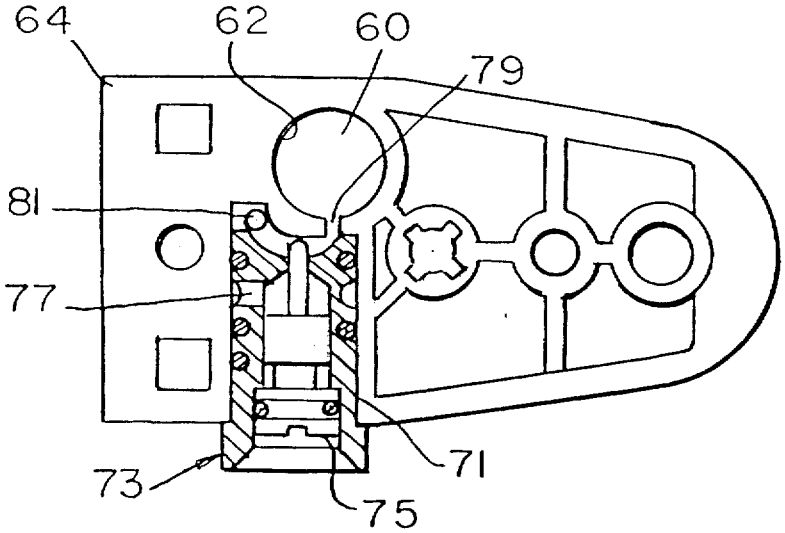
Figure 9:
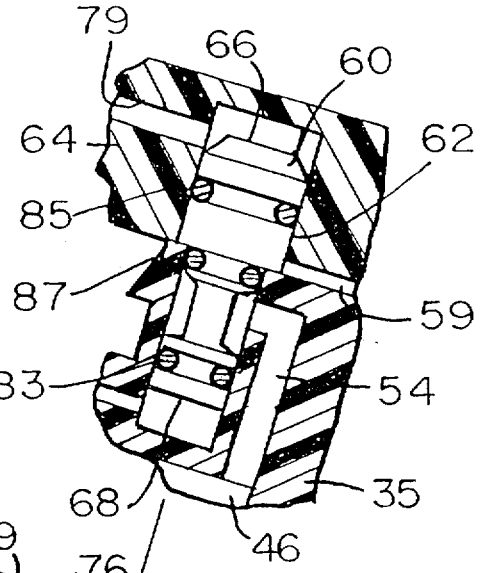
Figure 8:
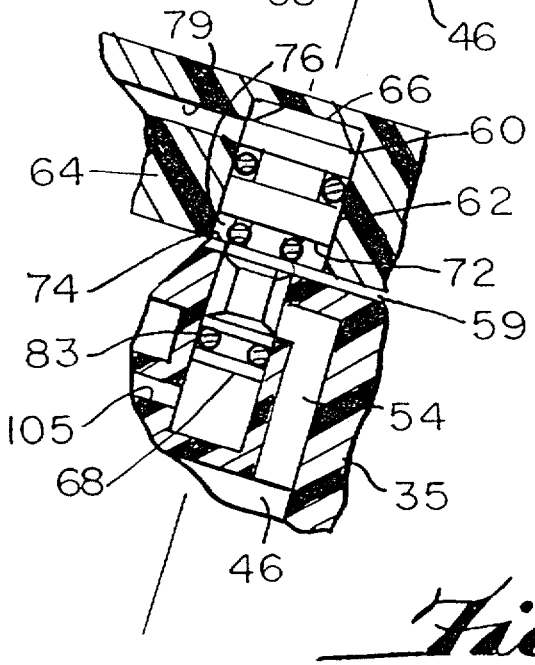
Figure 7:
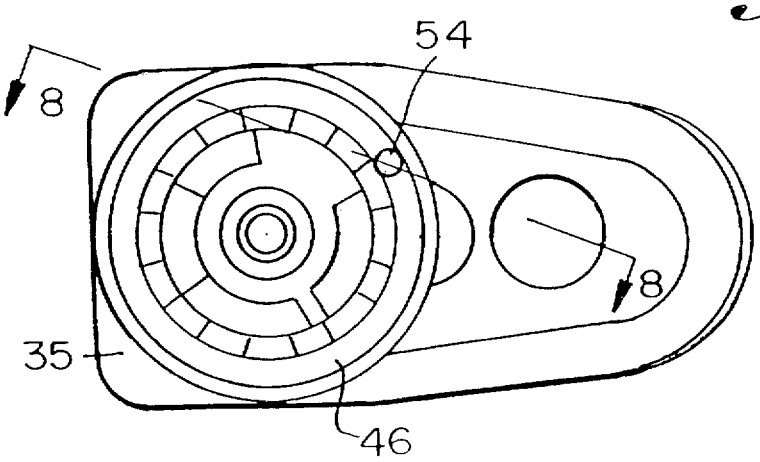

With reference to FIGS. 7–9, a main valve trigger port 54 connects the pressure chamber 46 and a first exhaust port 58 (FIG. 2) via a restrictive bleed path 59, the function of which will be apparent below.

Figure 6:
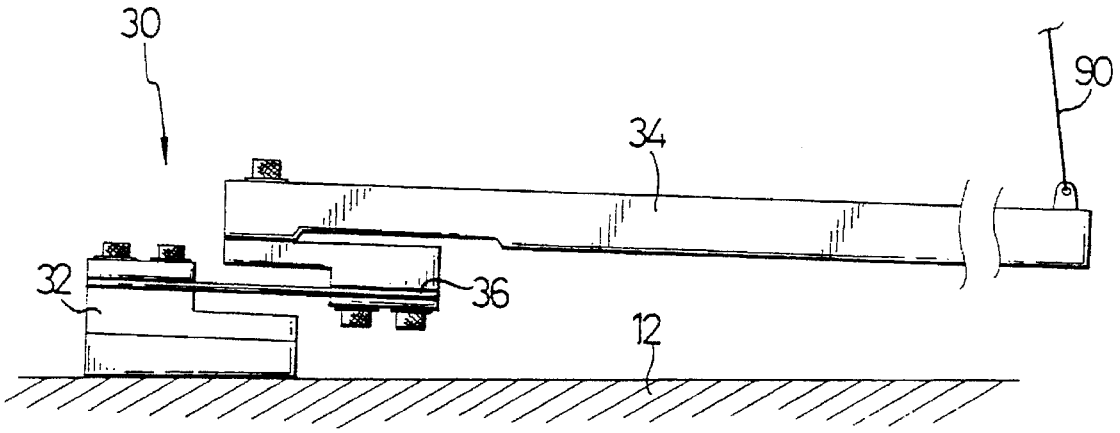
FIG. 6 is a view taken along the line 6—6 of FIG. 1.

The control valve assembly 28 includes a secondary valve structure in the form of a shuttle valve 60 mounted in bore 62 of trigger housing 64. The shuttle valve 60 has a first effective pressure surface 66 which is in pressure communication with over-the-piston pressure. The term "over-the-piston pressure" means pressure which is communicating with the piston 24. This pressure may be low or high pressure, depending on what part of the cycle the device is operating. Such communication is achieved since surface 66 communicates with the axial passage structure 42, which includes passage 67 of valve housing 35 and passage 69 of housing 64. Passage 64 communicates with a needle valve assembly 73 at pressure path 77. Bore 71 houses the needle valve assembly 73 (FIG. 6) which includes a manually adjustable needle valve 75. Pressure path 77 communicates with needle valve 75, and bleed bore 79. Needle valve bleed bore 79 communicates with the shuttle valve 60, as shown in FIGS. 8 and 9. Port 81 communicates the pressure cavity 92 (FIG. 5) with the bore 79 of the needle valve assembly. The restriction defined by the needle valve 75 selectively controls the piston dwell at the top of its stroke.

The shuttle valve 60 has a second effective pressure surface 68 opposing the first effective pressure surface 66 and in communication with the reservoir chamber via port 105. Surface 66 is larger than surface 68. As shown in FIG. 8, when the shuttle valve 60 is in its opened position normally biased by reservoir pressure at surface 68, communicated from port 105, the main valve trigger port 54 communicates with the restrictive bleed path 59. Port 105 communicates directly with the reservoir chamber 22. O-ring 83 prevents the high pressure from passing the shuttle valve 60.

With reference to FIG. 9, when over-the-piston pressure or high pressure acts on surface 66 imposing a greater force than a force acting on surface 68 due to reservoir pressure communicating therewith, the shuttle valve 60 is moved towards its closed position wherein surface 72 of the valve 60 engages surface 74 of the housing so as to prevent communication between port 54 and the bleed path 59. O-ring 85 isolates pressure in bore 79 from pressure in bleed path 59 and O-ring 87 isolates the bleed path from the trigger port 54.

Figure 5:
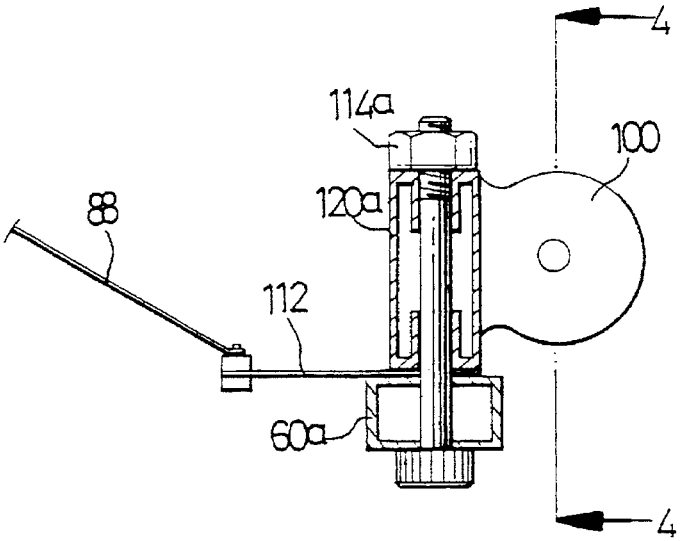
FIG. 5 is a view taken along the line 5—5 of FIG. 1.

As shown in FIG. 5, the restrictive bleed path 59 connects the main valve trigger port 54 with the trigger stem bore 76. The trigger stem bore 76 defines the first exhaust port 58. A trigger stem 80, defining a first actuating member, is carried by the housing 64 for movement from a normal, sealed position into an operative, unsealed position for initiating movement of the main valve 34 to its open position, thereby initiating movement of the fastener driving element 26 through a fastener drive stroke. The first actuating member 80 is normally biased to its normal, sealed position by a coil spring 82. As shown in FIG. 1, in the sealed position, surface 84 of actuating member 80 engages housing surface 86 with an O-ring compressed therebetween, sealing the first exhaust port 58.

An automatic trigger stem, defining a second actuating member 88, is carried by the housing 64 for movement from a normal, unsealed position into an operative, sealed position for initiating movement of the shuttle valve 60 to its closed position. The second actuating member 88 is disposed in bore 90 which defines a second exhaust port 91. As shown in FIGS. 1–4, the second actuating member 88 is normally biased to its normal, unsealed position by a spring 93. The second actuating member 88 seals a second exhaust port 91 when in its sealed position, as will become apparent below. As shown in FIG. 5, the pressure cavity 92 is in pressure communication with bore 90, housing the second actuating member 88, and in communication with port 81.

With reference to FIGS. 1–4, the control valve assembly 28 includes a trigger assembly including a trigger member 30 pivoted to the housing 64 at pin 95 for manual movement from a normal, inoperative position into operative positions. The trigger member 30 is normally biased downwardly by a spring 96. The spring 96 is disposed between a surface of the trigger member 30 and a surface of the trigger housing 64. The trigger assembly also includes a rocker arm 98 which is pivoted to the trigger member 30 via pin 99. The first and second actuating members 80 and 88 are constructed and arranged such that movement of the trigger member 30 a first distance of travel causes the rocker arm 98 to engage and move the first actuating member 80 from its sealed position to its operative, unsealed position. Movement of the trigger member 30 further, a second distance of travel, moves the second actuating member 88 from its unsealed, inoperative position to its sealed, operative position.

As shown in FIGS. 1–4, trigger member sensitivity adjustment structure, generally indicated at 100, is carried by the housing 64 and constructed and arranged to adjust to the movement of the trigger member 30 to provide the operator a selection of single actuation followed by automatic actuation of the device, or automatic actuation of the device only, as explained more fully below. The adjustment structure 100 includes a trigger stop 102 which is constructed and arranged engage the rocker arm 98 in the inoperative position of the trigger member 30 to limit or control movement of the rocker arm 98. An adjustment knob 104 is cooperable with the trigger stop 102 so as to manually adjust the vertical position of the trigger stop 102. By adjusting the trigger stop 102 to its most upward position or towards the trigger member 30, the device 10 will single actuate followed by automatic actuation as explained below. At this setting, the rocker arm 98 initially strokes the trigger stem 88 to its unsealed position, hence single actuation occurs. As the trigger member 30 is pulled further, the automatic trigger stem 80 is then stroked to its sealed position by the rear portion of the trigger member 30, permitting automatic actuation. The adjustment knob 104 enables the operator to set the trigger sensitivity by adjusting the trigger member 30 pull distance from the moment the device single actuates to the automatic actuation mode.

By adjusting the trigger stop 102 to its most downward position or away from the trigger member 30, the device 10 will automatic actuate only. At this setting, when the trigger member 30 is pulled fully to its second distance of travel, the automatic trigger stem 80 is stroked to its sealed position before the trigger stem 80 is stroked to its unsealed position, hence automatic actuation occurs without single actuation.

Operation

1. Single Actuation Sequence

To operate the device 10 in a single actuation mode of operation, initially, the trigger member 30 is digitally operated or pivoted upwardly a first distance of travel so that the rocker arm 98 strokes the trigger stem 80 to its unsealed position which releases high pressure air under the main valve 34. Over-the-piston or high pressure air in chamber 46 bleeds through to main valve trigger port 54 through the restrictive path 59 past the trigger stem 80 through the first exhaust port 58 to atmosphere. Thus, as surface 38 is exposed to low pressure air, high pressure air acting on surface 40 overcomes the bias of spring 52 moving the main valve 34 off seat 44. The high pressure air in the reservoir chamber 22 communicates with passage 36 and passage structure 42 forces the main valve 34 open thus permitting the high pressure air to communicate with the one end 37 of the cylinder 20 to move the piston 24 in the direction to effect the drive stroke of the fastener driving device 10. In this position, the exhaust path 106 is closed. Over-the piston air or high pressure air then bleeds through the axial passage structure 42, through pressure path 77 and needle valve bleed bore 79 under the shuttle valve 60 and into port 81 and cavity 92. Cavity 92 is in communication with the over-the-piston high pressure air and the biased open shuttle valve 60. Finally, the high pressure air then bleeds past the automatic trigger stem 88 and out the second exhaust port 91 to atmosphere. Thus, the pressure in cavity 92 becomes low and the shuttle valve 60 remains in its open position. Because the automatic trigger stem 88 is unsealed, the high pressure air cannot build-up high enough at surface 66 to overcome the force of reservoir pressure on surface 68 to shift the shuttle valve 60 to its closed position. The shuttle valve 60 is biased by reservoir or high pressure acting on surface 68. While the trigger member 30 is held in this position, high pressure continues to bleed through the main valve automatic feed orifice 48 (FIG. 1) and out past the first exhaust port 58. Since the area of exhaust port 58 is larger than orifice 48, the main valve 34 cannot shift closed. When the trigger member 30 is released, the trigger stem 80 then moves to its sealed position. High pressure air fills chamber 46 via orifice 48, which acts on surface 38. Thus, the force of the spring 52 plus the force due to the high pressure air acting on surface 38 is greater than the force due to high pressure acting on the opposing surface 40. Therefore, the main valve 34 is moved to its closed position and the exhaust path 106 is opened to atmosphere. This concludes the single actuation sequence of operation of the device 10.

2. Automatic Actuation Sequence

Figure 4:
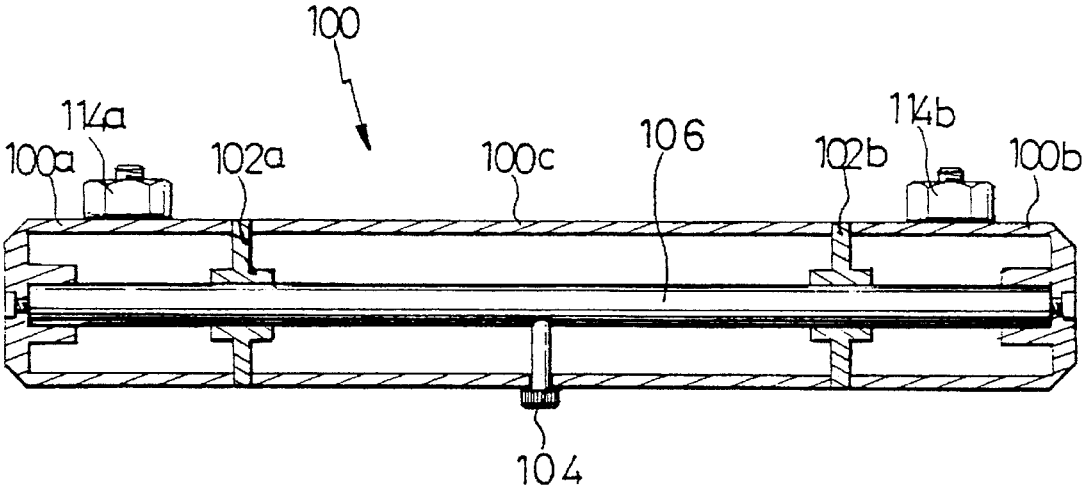
FIG. 4 is a view similar to FIG. 1, with the control valve assembly in a single actuation mode of operation, in position to initiate the return stroke of the piston.

With reference to FIGS. 3 and 5–7, when the trigger member 30 is stroked further such that the automatic trigger stem 88 is moved to its sealed, operative position, over-the-piston pressure air builds in cavity 92 communicating with surface 66 of the shuttle valve 60, thus shifting the shuttle valve 60 to its closed position. This occurs since surface 66 of the shuttle valve is larger than surface 68. Cavity 92 creates a pressure delay to allow the operator to stroke the automatic trigger stem 88 closed before the shuttle valve 60 shifts to its closed position. This prevents the device 10 from skipping during the transition from single to automatic actuation. Port 54 and hence path 59 and exhaust port 58 are then sealed by the shuttle valve 60. Thus, chamber 46 is filled with reservoir pressure via feed orifice 48. Orifice 48 controls the piston dwell at the bottom of its stroke. High pressure air then shifts the main valve 34 to its closed position in the manner discussed above. Over-the-piston pressure exhausts through the exhaust paths 106 and 108 which define exhaust path structure (FIG. 4). Over-the-piston pressure in cavity 92 bleeds through port 81 (FIG. 5) past the needle valve 75 then bleeds through the pressure path 77, through passage 69 and housing passage 67 of the axial passage structure 42 and finally out through the exhaust paths 106 and 108. High pressure under the shuttle valve 60 acting on surface 66 bleeds to the atmosphere, thus reservoir pressure on surface 68 shifts the shuttle valve 60 to its open position. The reservoir pressure under the main valve 34 in chamber 46 is then released through port 54 through the restricted path 59 past the trigger stem 80 to atmosphere. High pressure in reservoir 22 forces the main valve 34 to its open position in the manner discussed above thus driving the piston 24 downwardly. This concludes the automatic sequence of operation. The working cycle of the piston is repeated as long as the trigger member is held in its second position of operation. Release of said trigger member 30 returns the device to its rest position (FIG. 1).

With reference to FIGS. 8 and 9, the function of the restrictive path 59 will be appreciated. When the main valve trigger port is open, restricted exhaust air in restrictive path 59 creates high pressure over the shuttle valve 60 on surface 72. The shuttle valve 60 is thus shifted to its open position by both the high pressure air acting on surface 68 and discharge air acting on the shuttle valve 60 on surface 72 at port 54. The path 59 further creates a high pressure bleed delay under the main valve 34 which allows cavity 92 to bleed down fully to atmosphere. These two features ensure a full shuttle valve stroke. Further, bleed path 59 ensures consistent speed cycles during the automatic cycle of operation. Thus, variation in stem 80 stroke can occur via the bleed path between surface 86 and o-ring 87.

It can be appreciated that by positioning the main valve 34 in the frame of the device 10, the overall tool height is reduced. Further, since the control valve assembly 28 is in the form of a single unit removable from the housing 12, the device is easy to assembly and service.

It thus will be appreciated that the objects of the invention have been fully and effectively accomplished. It will be realized, however, that the foregoing preferred embodiment of the present invention has been shown and described for the purpose of illustrating the structural and functional principles of the present invention and are subject to change without departure from such principles. Thus, the invention includes all modifications encompassed within the spirit of the following claims.

What is claimed is:

1. A pneumatically operated driving device constructed and arranged to operate in a single actuation sequence and an automatic actuation sequence, comprising:

a housing defining a fastener drive track, said housing including a cylindrical housing portion and a frame housing portion extending laterally from the cylindrical housing portion, a fastener magazine for feeding successive fasteners laterally into the drive track, a fastener driving element slidably mounted in the drive track for movement through an operative cycle including a drive stroke during which a fastener within the drive track is engaged and moved longitudinally outwardly of the drive track into a workpiece and a return stroke, a drive piston connected with the fastener driving element, a cylinder within which the piston is reciprocally mounted, an air pressure reservoir communicating exteriorly with one end of the cylinder via a passageway, a control valve assembly for opening said passageway and communicating reservoir pressure within the interior of the one end of the cylinder to move the piston in a direction to effect the drive stroke of the fastener driving element and for closing said passageway and communicating the one end of the cylinder with atmosphere for permitting the piston to move in a direction to effect the return stroke of the fastener driving element, said control valve assembly including:

a housing assembly mounted with respect to the frame portion of the housing, a main valve mounted with respect to said housing assembly and being moveable between open and closed positions to open and close said passageway;

pressure responsive secondary valve mounted in said housing assembly and structure constructed and arranged to permit the device to operate in the automatic actuation sequence;

a first actuating member for initiating the single actuation sequence of operation constructed and arranged for movement from a sealed position into an unsealed position for initiating movement of said main valve to its open position, thereby initiating movement of the fastener driving element through a fastener drive stroke;

a second actuating member mounted for movement from a normal, unsealed position into an operative, sealed position for initiating movement of said secondary valve structure permitting the device to operate in the automatic actuation sequence, a trigger assembly mounted to said housing assembly for manual movement from a normal, inoperative position into operative position, said first and second actuating members being constructed and arranged such that (1) pivotal movement of said trigger member a first distance of travel moves said first actuating member from its normal, sealed position to its operative, unsealed position causing the device to single actuate and (2) pivotal movement of said trigger member further to a second distance of travel moves said second actuating member from its normal, unsealed position to its operative, sealed position initiating the automatic actuation sequence, and trigger assembly adjustment structure constructed and arranged to engage a portion of the trigger assembly in its inoperative position so as to control pivotal movement of said trigger member portion, thereby providing operator selection of single actuation followed by automatic actuation of the device, or automatic actuation thereof only.

2. The fastener driving device according to claim 1, wherein said control valve assembly is constructed and arranged to be removable from said frame portion of said housing as a unit.

3. The fastener driving device according to claim 1, wherein said trigger assembly includes a manually moveable trigger member pivoted to said housing assembly and a rocker arm pivoted to said trigger member so as to engage the first actuating member when said trigger assembly is moved said first distance of travel, said trigger assembly adjustment structure including a trigger stop constructed and arranged to engage and limit movement of the rocker arm when the trigger assembly is in its inoperative position, and an adjustment member cooperable with the trigger stop so as to manually adjust a position of the trigger stop, whereby (1) when said trigger stop is adjusted towards said trigger assembly to a first position of operation, movement of said trigger assembly said first distance of travel causes the rocker arm to engage the first actuating member resulting in a single actuation of the device, and further movement of said trigger assembly to said second distance of travel causes the trigger member to engage the second actuating member resulting in the automatic actuation sequence and (2) when said trigger stop is adjusted away from said trigger assembly to a second position of operation, movement of the trigger assembly member will actuate only the second actuating member so that the device will operate only in the automatic actuation sequence.

4. In a pneumatically operated driving device constructed and arranged to operate in a single actuation sequence and automatic actuation sequence, the device including a control valve assembly for permitting reservoir pressure to communicate with one end of a cylinder housing a piston to move the piston in a direction to effect a drive stroke of a fastener driving element and for communicating the one end of the cylinder with atmosphere permitting the piston to move in a direction to effect the return stroke of the fastener driving element, the control valve assembly including a main valve mounted between said one end of said cylinder and a pressure reservoir and being moveable between opened and closed positions, secondary valve structure constructed and arranged to permit the device to operate in the automatic actuation sequence, a first actuating member for initiating the single actuation sequence constructed and arranged for movement from a sealed position into an unsealed position for initiating movement of said main valve to its opened position, thereby initiating movement of the fastener driving element through a fastener drive stroke, and a second actuating member mounted for movement from a normal, unsealed position into an operative, sealed position for initiating movement of said secondary valve structure permitting the device to operate in the automatic actuation sequence, and a trigger member mounted for manual movement from a normal, inoperative position into an operative position, said first and second actuating members being constructed and arranged such that movement of said trigger member a first distance of travel moves said first actuating member from its normal, sealed position to its operative, unsealed position, movement of said trigger member further to a second distance of travel moves said second actuating member from its normal, unsealed position to its operative, sealed position, the improvement comprising:

trigger member adjustment structure constructed and arranged to engage a portion of the trigger member in its inoperable position so as to control pivotal movement of said trigger member portion, thereby providing operator selection of single actuation followed by automatic actuation of the device, or automatic actuation thereof only.

5. A pneumatically operated fastener driving device comprising:

a housing defining a fastener drive track, a fastener magazine for feeding successive fasteners laterally into the drive track, a fastener driving element slidably mounted in the drive track for movement through an operative cycle including a drive stroke during which a fastener within the drive track is engaged and moved longitudinally outwardly of the drive track into a workpiece and a return stroke, a drive piston connected with the fastener driving element, a cylinder within which the piston is reciprocally mounted, an air pressure reservoir communicating exteriorly with one end of the cylinder via a passageway, a control valve assembly for opening said passageway and communicating the reservoir pressure within the interior of the one end of the cylinder to move the piston in a direction to effect the drive stroke of the fastener driving element and for closing said passageway and communicating the one end of the cylinder with atmosphere for permitting the piston to move in a direction to effect the return stroke of the fastener driving element, said control valve assembly comprising:

main control valve structure including a main valve mounted within a housing assembly, said main valve being disposed between said one end of said cylinder and said pressure reservoir and being moveable between opened and closed positions to open and close said passageway, said main valve having first and second opposing pressure responsive surfaces, said main control valve structure including an axial passage therethrough;

an exhaust path connecting said passageway with the atmosphere when said main valve is in its closed position, said exhaust path communicating with said axial passage, a pressure chamber in communication with the pressure reservoir via a feed orifice therebetween, said pressure chamber being disposed between said first pressure responsive surface and a portion of said housing assembly;

spring structure biasing said main valve to its closed position;

a main valve trigger port between said pressure chamber and a first exhaust port;

secondary valve structure, between said main valve trigger port and said first exhaust port, including a valve having first and second opposing effective pressure surfaces, said valve of said secondary valve structure being constructed and arranged to move between opened and closed positions to open and close said first exhaust port due to changes in pressure exerted on the first and second effective pressure surfaces, a first actuating member carried by said housing for movement from a normal, sealed position into an operative, unsealed position for initiating movement of said main valve to its open position, thereby initiating movement of the fastener driving element through a fastener drive stroke, said first actuating member sealing said first exhaust port when in said sealed position, a second actuating member carried by said housing for movement from a normal, unsealed position into an operative, sealed position for initiating movement of said valve of said secondary valve structure to its closed position, said second actuating member sealing a second exhaust port when in said sealed position, said second exhaust port communicating with said axial passage, a pressure cavity in pressure communication with said second exhaust port and said first effective pressure surface of said valve of said secondary valve structure, a trigger assembly pivoted to said housing for manual movement from a normal, inoperative position into an operative position, said first and second actuating members being constructed and arranged such that movement of said trigger assembly a first distance of travel moves said first actuating member from its normal, sealed position to its operative, unsealed position, movement of said trigger assembly further to a second distance of travel moves said second actuating member from its normal, unsealed position to its operative, sealed position, and trigger assembly adjustment structure carried by said housing assembly and being constructed and arranged to adjust pivotal movement of said trigger assembly thereby providing operator selection of single actuation followed by automatic actuation of the device, or automatic actuation thereof only, whereby, in a single actuation mode of operation, movement of said trigger assembly said first distance of travel moves said first actuating member to its operative, unsealed position which in turn releases pressure in said pressure chamber acting on said first pressure responsive surface of the main valve through said main trigger port and through said first exhaust port to atmosphere, causing reservoir pressure to act on said second pressure responsive surface of said main valve thereby opening the main valve and closing the exhaust path, initiating a fastener drive stroke, pressure then communicating with the axial passage passing the opened valve of the secondary valve structure and entering said pressure cavity and bleeding through said second exhaust port to atmosphere, pressure bleeding through said feed orifice into said pressure chamber and through said first exhaust port to atmosphere maintaining the main valve in its opened position, and release of said trigger member causing said first actuating member to move to its normal, sealed position sealing said first exhaust port causing pressure to fill said pressure chamber via said feed orifice and act on said first pressure responsive surface causing the main valve to move to its closed position and opening the exhaust path, whereby, in an automatic actuation mode of operation, movement of said trigger assembly said second distance of travel moves said second actuating member to its operative, sealed position so that pressure in said pressure cavity acts on said first effective pressure surface and moves the valve of the secondary valve structure to its closed position sealing said main valve trigger port, with pressure filling said pressure chamber via the feed orifice and acting on said second pressure responsive surface of the main valve thereby moving the main valve to its closed position, pressure within the interior of said one end of the cylinder exhausting to atmosphere through said exhaust path, pressure acting on said first effective pressure surface bleeding to atmosphere via said axial passage and said exhaust path thereby moving the valve of the secondary valve structure to its opened position so that pressure in said pressure reservoir acts on said first pressure responsive surface to open said main valve and initiate a fastener drive stroke.

6. The fastener driving device according to claim 5, wherein said trigger assembly includes a manually moveable trigger member pivoted to said housing assembly and a rocker arm pivoted to said trigger member so as to engage the first actuating member when said trigger assembly is moved said first distance of travel, said trigger assembly adjustment structure including a trigger stop constructed and arranged to limit movement of the rocker arm, and an adjustment member cooperable with the trigger stop so as to manually adjust a position of the trigger stop, whereby, when said trigger stop is adjusted towards said trigger assembly to a first position of operation, the device will single actuate followed by automatic actuation as the trigger assembly is moved said first distance of travel, and when said trigger stop is adjusted away from said trigger assembly to a second position of operation, the device will operate only in an automatic mode of operation as the trigger assembly is moved said second distance of travel.

7. The fastener driving device according to claim 5, further comprising a restrictive bleed path connecting said main valve trigger port with said first exhaust port, said valve of said secondary valve structure preventing communication between said main valve trigger port and said first exhaust port when in its closed position, when said valve of said secondary valve structure is in its opened position, said bleed path is constructed and arranged to (1) exert high pressure on the valve of the secondary valve structure and (2) provide a bleed delay of reservoir pressure from said pressure chamber so as to permit said pressure chamber to bleed fully to atmosphere, thereby ensuring a full stroke of said valve of said secondary valve structure.

8. The fastener driving device according to claim 5, further comprising a needle valve assembly including an adjustable needle valve disposed in a passage between said axial passage and said valve of said secondary valve structure, said needle valve being constructed and arranged to selectively restrict said passage so that during automatic actuation of the device, the restricted passage being constructed and arranged to control dwell of said piston at a top of its stroke.

9. The fastener driving device according to claim 5, wherein said second actuating member is biased by a spring to its normal, unsealed position by a spring.

10. The fastener driving device according to claim 5, wherein said first actuating member is biased by a spring to its normal, sealed position by a spring.

11. The fastener driving device according to claim 5, wherein said first effective pressure surface is larger than said second effective pressure surface and is exposed to pressure over the piston at said one end of said cylinder, and said second effective pressure surface communicates with the pressure reservoir.

* * * * *

UNITED STATES PATENT AND TRADEMARK OFFICE

CERTIFICATE OF CORRECTION

PATENT NO. : 5,653,369

DATED : August 5, 1997

INVENTOR(S) : Brian M. White

It is certified that error appears in the above-identified patent and that said Letters Patent is hereby corrected as shown below:

The title page, showing the illustrative figure, should be deleted and substite therefor the attached title page.

On the title page correct

"11 Claims, 8 Drawing Sheets" to --11 Claims, 6 Drawing Sheets--.

Please replace incorrect drawings (Figs. 1-10) with drawings (Figs. 1-9) attached hereto.

Signed and Sealed this

Ninth Day of February, 1999

*Attest:*

*Attesting Officer*

*Acting Commissioner of Patents and Trademarks*

United States Patent [19]

White

[11] Patent Number: 5,653,369

[45] Date of Patent: Aug. 5, 1997

[54] FASTENER DRIVING DEVICE WITH IMPROVED CONTROL VALVE ASSEMBLY AND TRIGGER SENSITIVITY ADJUSTMENT

[75] Inventor: Brian M. White, Riverside, R.I.

[73] Assignee: Stanley-Bostitch, Inc., East Greenwich, R.I.

[21] Appl. No.: 559,377

[22] Filed: Nov. 16, 1995

[51] Int. Cl.[6] ..... B25C 1/04

[52] U.S. Cl. ..... 227/8; 227/130; 91/308; 91/309; 91/321; 91/356

[58] Field of Search ..... 227/8, 130; 91/236, 91/307, 308, 309, 321, 356

[56] References Cited

U.S. PATENT DOCUMENTS

| | | | |
|---|---|---|---|
| 3,278,103 | 10/1966 | Juilfs et al. . | |
| 3,278,105 | 10/1966 | Juilfs et al. . | |
| 3,427,928 | 2/1969 | Bade . | |
| 3,547,003 | 12/1970 | Ramspeck . | |
| 3,583,496 | 6/1971 | Fehrs . | |
| 3,895,562 | 7/1975 | El Guindy . | |
| 4,509,668 | 4/1985 | Klaus et al. | 227/130 |
| 4,915,013 | 4/1990 | Moraht et al. . | |
| 5,174,485 | 12/1992 | Meyer | 227/8 |
| 5,370,037 | 12/1994 | Bauer et al. . | |
| 5,522,532 | 6/1996 | Chen | 227/8 |

*Primary Examiner*—Scott A. Smith

*Attorney, Agent, or Firm*—Cushman, Darby & Cushman IP Group of Pillsbury Madison & Sutro LLP

[57] ABSTRACT

A pneumatically operated driving device is constructed and arranged to operate in a single actuation sequence and an automatic actuation sequence. The device includes an improved control valve assembly for communicating reservoir pressure to move a piston in a direction to effect a drive stroke of a fastener driving element and for permitting the piston to move in a direction to effect the return stroke of the fastener driving element. The control valve assembly includes a main valve, a secondary valve, and first and second actuating members for controlling movement of the main and secondary valves, a trigger member for moving the actuating members, and trigger member adjustment structure constructed and arranged to adjust pivotal movement of the trigger member thereby providing operator selection of single actuation followed by automatic actuation of the device, or automatic actuation thereof only. The control valve assembly may be removed from the device as a unit.

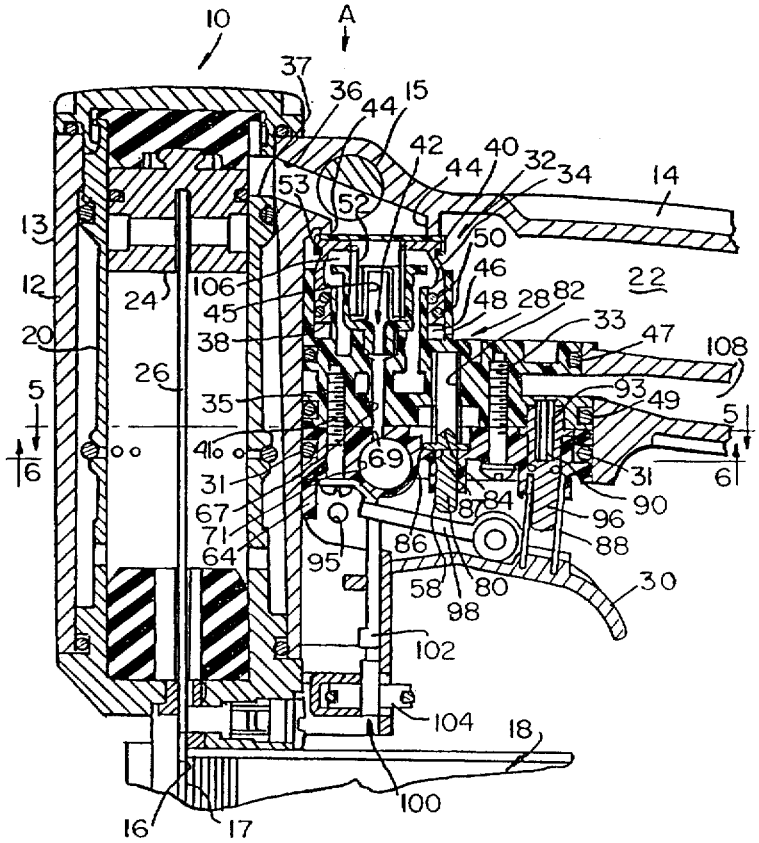

11 Claims, 6 Drawing Sheets